United States Patent [19]

Close

[11] 4,047,410

[45] Sept. 13, 1977

[54] MECHANISM FOR RELEASING DEVICE ATTACHING AN ANTI-THEFT MONITOR TO MERCHANDISE

[75] Inventor: Leo R. Close, Granada Hills, Calif.

[73] Assignee: Mrs. Lawrence Israel, Los Angeles, Calif.

[21] Appl. No.: 687,014

[22] Filed: May 17, 1976

Related U.S. Application Data

[62] Division of Ser. No. 563,480, March 31, 1975, Pat. No. 3,973,418.

[51] Int. Cl.[2] ..... E05B 19/14

[52] U.S. Cl. ..... 70/401

[58] Field of Search ..... 24/108, 110, 201 R, 24/211 R, 211 L, 230 AT; 70/1, 336, 337, 339, 401; 81/3 R; 29/200 R, 200 H; 173/50; 259/84, 104

[56] References Cited

U.S. PATENT DOCUMENTS

| | | | |
|---|---|---|---|
| 92,479 | 7/1869 | Sawyer | 259/84 |
| 863,543 | 8/1907 | Lomax | 24/108 X |
| 1,390,251 | 9/1921 | Schoppner | 259/104 X |
| 3,638,285 | 2/1972 | Giraldez | 24/108 |
| 3,858,280 | 1/1975 | Martens | 24/108 X |

FOREIGN PATENT DOCUMENTS

| | | | |
|---|---|---|---|
| 779,535 | 7/1957 | United Kingdom | 24/108 |

*Primary Examiner*—Lawrence J. Staab
*Attorney, Agent, or Firm*—Fraser and Bogucki

[57] ABSTRACT

A releasable, reusable, tamperproof device for attaching an anti-theft monitor to an article of merchandise is disclosed. The attachment device includes a tack adapted to be passed through the monitor and the article and into a keeper. The keeper encloses a one-way fastener of the type having opposed legs defining surfaces for gripping the pointed shank of the tack. Compression of the opposed legs to a releasing position permits withdrawal of the tack. In accordance with one embodiment, the keeper includes openings through which rotatable key means are insertable for engaging and displacing the legs to the tack-releasing position. In another embodiment the keeper incorporates flexible diaphragms dividing the keeper into a pair of side chambers separated by a central chamber enclosing the one-way fastener. Pressurization of the side chambers deflects the diaphragms into engagement with the fastener legs and causes displacement thereof to the tack-releasing position.

In accordance with another aspect of the invention a releasing mechanism is provided including key means and apparatus for supporting the monitor in operative relationship to the key means and for rotating the key means to effect release of the tack.

1 Claim, 14 Drawing Figures

Fig. 4
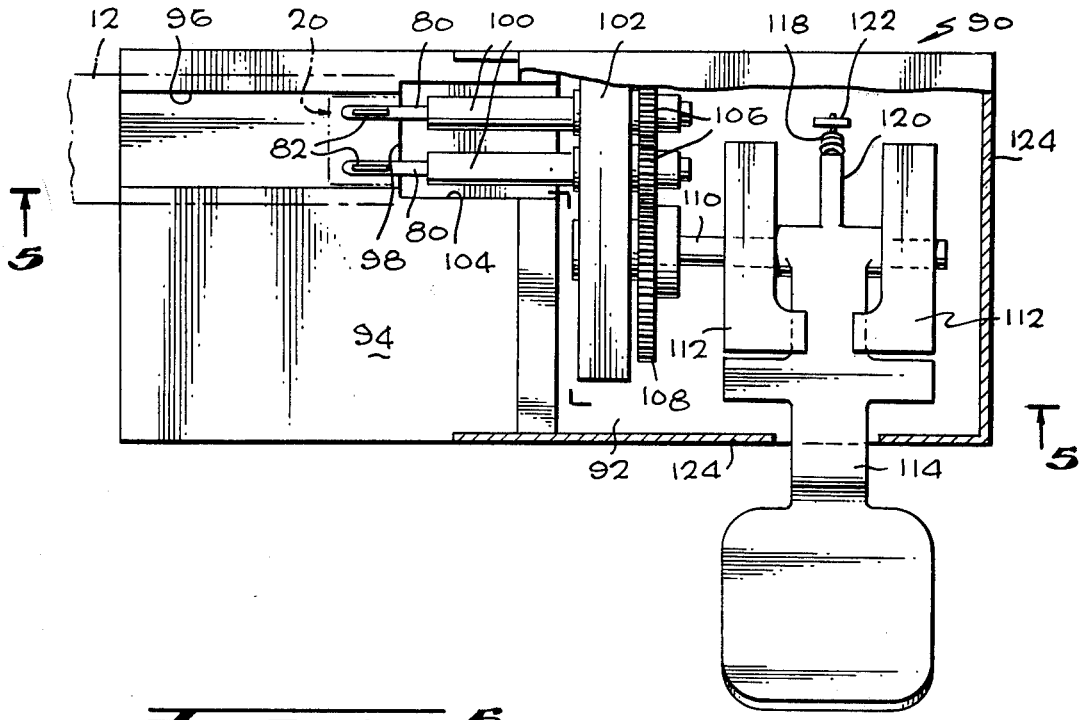
Fig. 5
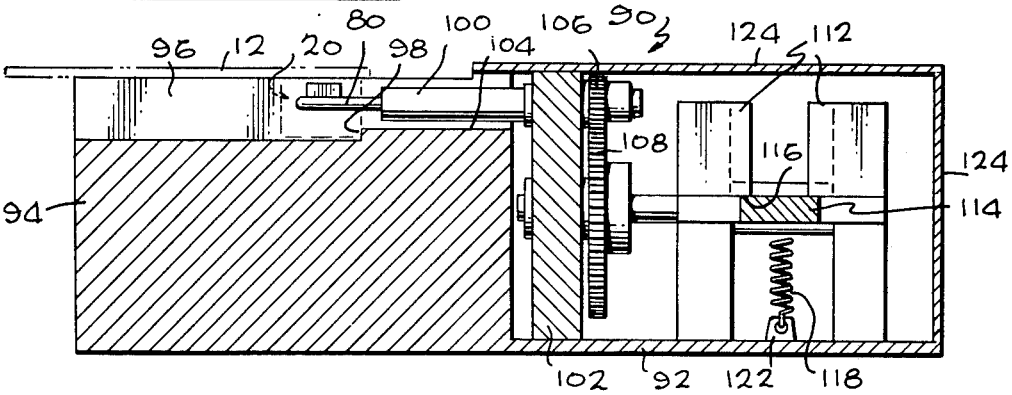
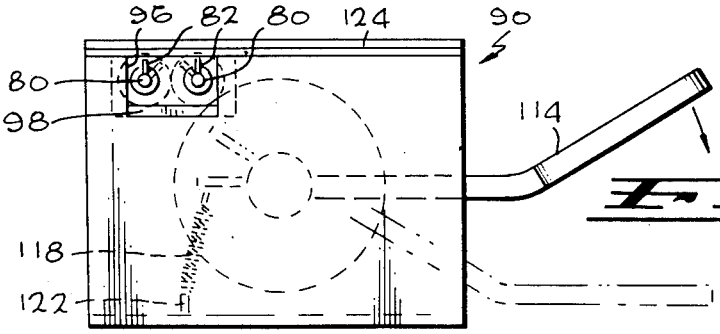
Fig. 6

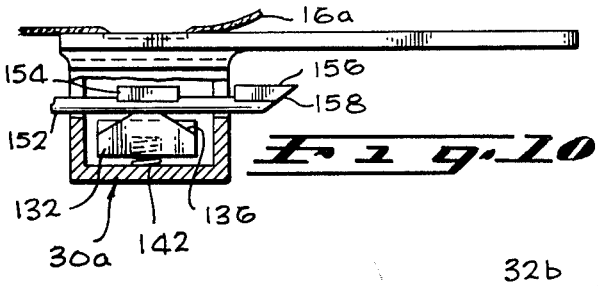
Fig. 10
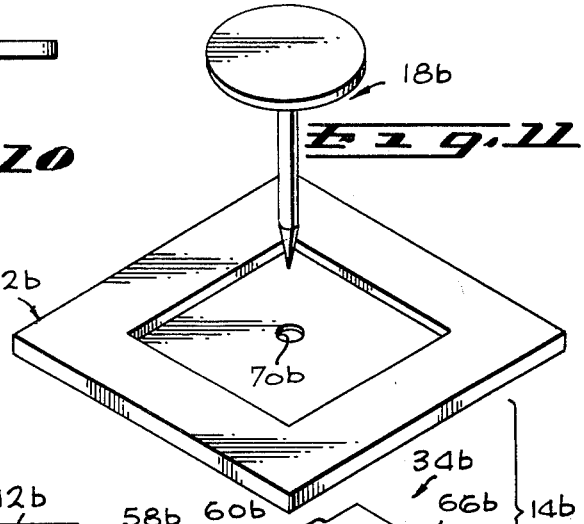
Fig. 11
Fig. 12
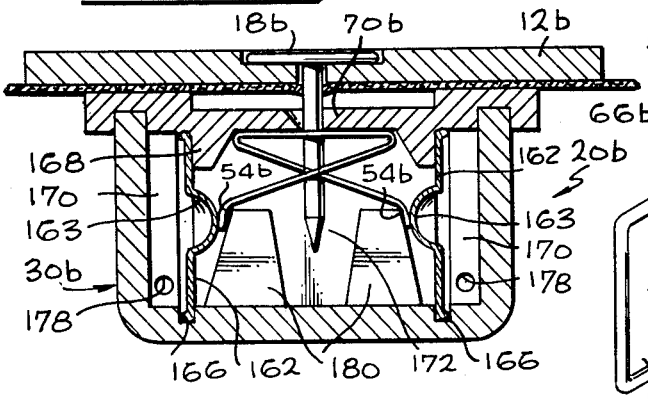
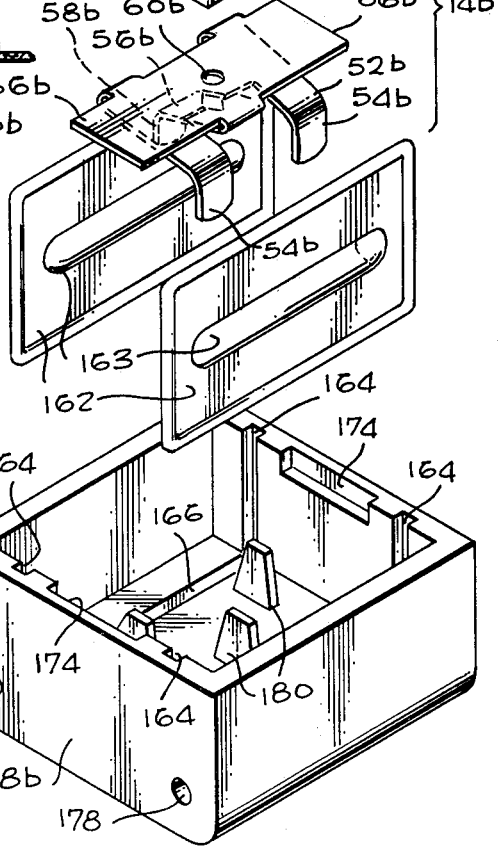
Fig. 14
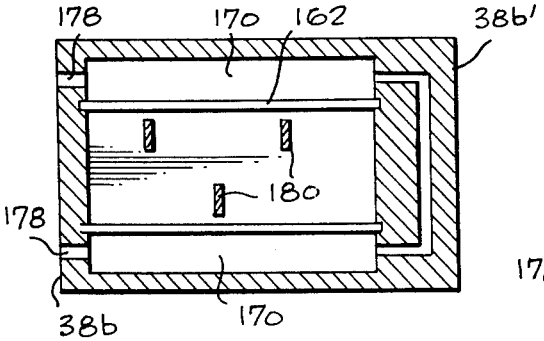
Fig. 13
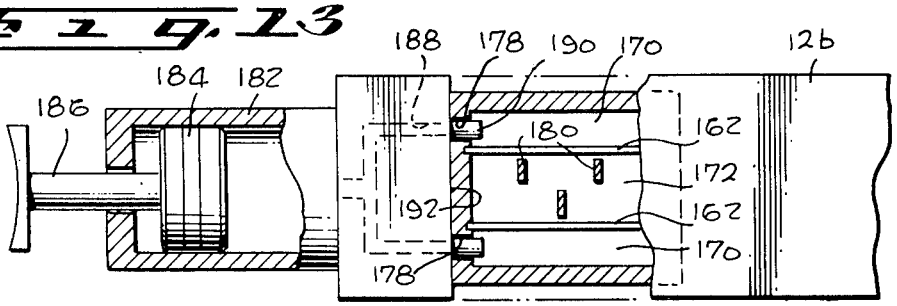

MECHANISM FOR RELEASING DEVICE ATTACHING AN ANTI-THEFT MONITOR TO MERCHANDISE

RELATED APPLICATION

This is a division of application Ser. No. 563,480, filed Mar. 31, 1975 and now U.S. Pat. No. 3,973,418.

FIELD OF THE INVENTION

This invention relates generally to anti-theft systems for monitoring merchandise and particularly to tamperproof, reusable devices for attaching monitoring apparatus such as radio frequency (RF) transponders to the merchandise.

BACKGROUND OF THE INVENTION

Systems are currently in use by retailers and others for monitoring merchandise such as garments by means of electronic detection devices attached to the merchandise. In the event an attempt is made to remove a piece of merchandise from the premises while such a detection device is attached, an alarm is triggered at a detection station near the store exit.

One of the more common detection devices is in the form of an RF transponder encapsulated within a plastic tag. The transponder comprises a circuit that resonates at the frequency of an RF signal generated at the detection station. The resonance of the transponder causes loading of the signal-producing oscillator which in turn triggers the alarm.

It is necessary, of course, that the transponder tag be attached to the merchandise by means that is tamperproof, does not damage the goods and yet is easily removable by authorized sales personnel.

One known device for attaching the transponder to an article of merchandise such as a garment consists of a tack having a pointed shank extending through a hole in the transponder, through the garment and into a keeper. The keeper includes a one-way clip having tabs for engaging the shank of the tack. The tabs are bent toward the back of the clip to permit easy entry of the shank; however, the tabs firmly grip the shank in a wedging action when an attempt is made to withdraw the tack. The back of the clip is permanently enclosed within a plastic housing to prevent access to the tack shank once it is pressed into the keeper.

In order to remove the transponder from the garment, the head of the tack must be severed and the entire fastener discarded. Hence, the economic disadvantages of this kind of fastener will be immediately apparent.

It is therefore desirable to have a transponder attachment device that is not only tamperproof and easily removable by special apparatus in the custody of sales personnel, but reusable as well.

SUMMARY OF THE INVENTION

In accordance with a specific, exemplary embodiment of the invention, there is provided a reusable, tamperproof device for attaching an anti-theft monitoring apparatus to a product, the attachment device being of the type employing a tack having a shank adapted to be passed through the monitoring device and the product and into a one-way, releasable keeper.

The keeper includes a housing having an interior defined by a cover and end walls extending transverse to a longitudinal direction. The cover includes a hole for receiving the shank of the tack and one of the end walls includes a pair of spaced-apart openings communicating with the interior of the housing. A one way releasable fastener is disposed inside the housing and carried by fastener supports forming part of the housing. The fastener, which may be of the "Tinnerman" type, includes opposed legs defining surfaces for gripping the shank of the tack. The legs are displaceable toward each other in a releasing direction to a shank-releasing position. The fastener is constrained by the support means to maintain the fastener gripping surfaces in shank-receiving alignment with the cover hole and to orient the releasing direction generally perpendicular to the longitudinal direction. The openings in the end wall of the housing are adapted to receive releasing means for displacing the opposed legs of the fastener to the tack-releasing position.

In accordance with another aspect of the invention, the opposed legs of the fastener have free ends adapted to cooperate with the releasing means insertable through the openings in the end wall. The distance between the openings in the end wall is greater, however, than the distance between the opposed leg ends so that the leg ends are not readily visible through the openings.

Pursuant to another feature of the invention, a blocking gate may be disposed within the housing and includes a pair of spaced-apart upright walls in alignment with the openings in the end wall of the housing. The blocking gate is movable between a blocking position, in which the upright walls at least partially overlap the openings, and a non-blocking position. A spring biases the blocking gate toward the blocking position. Key means insertable in the housing include cam surfaces for pushing the blocking gate to the non-blocking position and tabs which, when the key means is rotated, engage the free ends of the fastener and press them inwardly allowing the tack to be withdrawn.

As a further safeguard, the blocking gate may include a centrally disposed, generally cylindrically shaped crown which in the blocking position of the gate is interposed between the free ends of the legs. Releasing displacement of the leg ends is thereby prevented.

In accordance with another feature of the invention, a mechanism is provided for use by authorized personnel for quickly releasing the attaching device. In one example of this feature, the mechanism comprises a pair of horizontal, parallel spindles journalled for rotation in a support, the spindles being coupled for counterrotation and spaced apart a distance equal to the distance between the openings in the keeper housing. The key means for releasing the fastener are attached to the ends of the spindles and include tabs adapted to engage the fastener leg ends to displace such ends to the tack-releasing position upon rotation of the spindles. A suitable manual actuator is coupled to rotate the spindles.

In accordance with another embodiment of the invention in which the fastener is released pneumatically, the housing includes a pair of longitudinally extending, flexible diaphragms defining a pair of side chambers separated by a central chamber enclosing the fastener. Each opening in the end wall is in communication with one of the side chambers and the diaphragms are disposed adjacent the opposed legs of the fastener. Air introduced under pressure into the side chambers causes the diaphragms to deflect inwardly, that is, in the releasing direction, to engage and displace the legs of the fastener to the tack-releasing position.

BRIEF DESCRIPTION OF THE DRAWINGS

Further objects, advantages and features of the invention will become apparent from a reading of the detailed description below in conjunction with the accompanying drawings, in which:

FIG. 4 is a top view of an apparatus in accordance with another feature of the invention for releasing the attachment device of FIGS. 1-3;

FIG. 5 is a side elevation view of the apparatus of FIG. 4;

FIG. 6 is an end elevation view of the apparatus of FIG. 4;

FIG. 10 is a side elevation view of the monitoring apparatus of FIG. 7, partly in cross section, showing a portion of the releasing means in place within the attachment device;

FIG. 11 is an exploded, perspective view of an attachment device in accordance with a third embodiment of the invention;

FIG. 12 is a front elevation view, in cross section, of the attachment device of FIG. 11;

FIG. 13 is a top view, in somewhat schematic form and partly in cross section, of portions of an apparatus for releasing the attachment device of FIGS. 11 and 12; and FIG. 14 is a top view, in cross section, of an alternative embodiment of the attachment device of FIGS. 11 and 12.

DETAILED DESCRIPTION OF THE INVENTION

Figures 1, 2, 3:
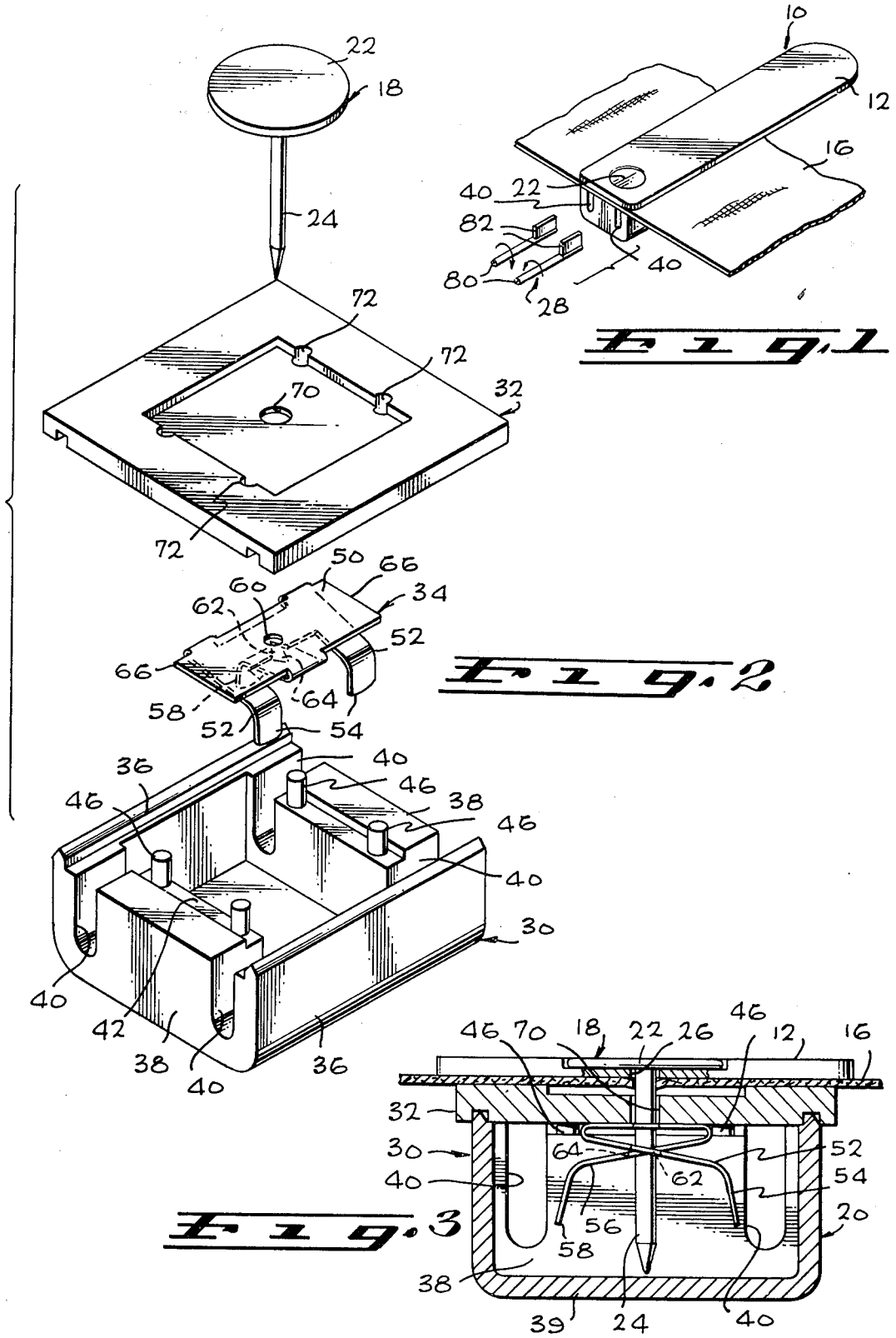
FIG. 1 is a perspective view of a merchandise monitoring apparatus secured to a garment, the apparatus including an attachment device according to a first embodiment of the invention, and showing a portion of an apparatus for releasing the attachment device.
FIG. 2 is an exploded, perspective view of the attachment device of FIG. 1.
FIG. 3 is a front elevation view, in cross section, of the attachment device of FIGS. 1 and 2.

With reference to FIG. 1, there is shown a merchandise monitor 10 comprising generally a transponder tag 12 and an attachment device 14. The monitor is attached to a garment 16 a portion of which is shown in the drawing.

The transponder tag 12, which does not form part of the present invention, contains electronic circuitry (not shown) that is caused to resonate in response to an RF signal generated near the store exit; as is well known in the art, resonance of the circuit is used to trigger an alarm.

Turning now also to FIGS. 2 and 3, the attachment device 14 comprises generally a tack 18 and a one-way keeper 20 for receiving the tack. The tack 18 has a conventional configuration and includes an enlarged head 22 carrying a pointed shank 24. In the embodiment of FIGS. 1-3 the tack 18 is passed through a hole 26 in the transponder tag 12, through the garment 16 and into the keeper 20. For reference purposes, the direction of orientation of the tack shank 24 in FIGS. 2 and 3 will be designated as the vertical direction.

As will be described in greater detail below, the one-way gripping action of the keeper 20 permits easy insertion of the tack but prevents withdrawal thereof once inserted. With the tack 18 in place as shown in FIG. 1, the garment 16 is firmly clamped between the transponder tag 12 and the keeper 20. The keeper 20 is released by releasing means in the form of key 28 comprising part of a release mechanism which will be described below.

The keeper 20 comprises generally a housing 30, a cover 32 and a one-way clip or fastener 34. The housing 30 has side walls 36 extending along a longitudinal direction, end walls 38 transverse to the longitudinal direction and a bottom wall 39. Each end wall 38 has a pair of parallel, vertical slots 40 into which the releasing means, such as key 28 is inserted and further includes fastener support and centering surfaces comprising an interior step 42 which defines a vertical shoulder 44. A pair of pegs 46 for receiving the cover 32 and for centering the fastener projects upwardly from each end wall 38. The slots 40 in one end wall are in longitudinal alignment with the slots in the other end wall.

The one-way fastener 34 is preferably of the type generally known as a Tinnerman fastener; an example thereof is described in detail in U.S. Pat. No. 2,367,283 issued Jan. 16, 1945. As is well known, such fasteners are made of spring sheet material and are designed to grip a stud or shank inserted in the fastener. Although such shank is easily inserted it cannot be readily removed unless portions of the fastener are manipulated to release the shank.

More specifically, the fastener 34 includes a base 50 having a pair of parallel legs 52 extending from one edge thereof and doubled over so that they pass under the base. The legs 52 terminate in release control surfaces in the form of hooked, free ends 54 that extend away from the base. A third, central leg 56 is attached to the opposite edge of the base 50 and is bent over to extend in a direction opposite that of the legs 52 and between said legs. The leg 56 terminates in a hooked, free end 58 which, like the ends 54, extends away from the base 50 and serves as a release control surface.

The base 50 has a central aperture 60 for receiving the tack shank 24. The legs 52 define between them a V-shaped notch 62 and the leg 56 has a V-shaped opening 64. The notch 62 and V-shaped opening 64 are vertically aligned with aperture 60 and in overlapping, opposed relationship so that the edges of the V-shaped notch 62 and the V-shaped portion of the opening 64 define gripping surfaces that bite into opposite sides of the shank 24 once it has been inserted into the fastener thereby preventing the tack from being withdrawn. The tack is released by pressing the hooked ends 54 and 58 inwardly to a tack-releasing position. In the preferred embodiment, the fastener is disposed inside the housing so that the direction of movement or displacement of the ends 54 and 58 between the gripping and releasing positions is generally perpendicular to the longitudinal direction of the housing.

The base 50 of the fastener 34 has lateral extensions 66 which are received by the portions of the end wall step 42 that lie between the pegs 46.

The cover 32 has a central hole 70 through which the shank 24 is passed into the fastener 34 and four outer holes 72 for receiving the pegs 46. After the cover 32 is installed, the projecting ends of the pegs 46 are sufficiently heated to enlarge them thereby permanently sealing the fastener 34.

It will thus be seen that the fastener is constrained in the vertical direction by the steps 42 and the cover 32 and is generally centered (to maintain the hole 60 sufficiently in alignment with the cover hole 70 so that the pointed shank of tack passes easily through the hole 70 into the hole 60) by the shoulders 44 and the pegs 46 which restrain the base extensions 66. It will be appreciated that the fastener may "float" to some extent within the housing so long as some overlap of the holes 60 and 70 is maintained to permit entry of the tack into the fastener.

In use, the tack 18 is inserted through the hole 26 in the transponder tag 12, through the garment 16 and into the keeper 20. It will be seen that any attempt to remove the transponder tag without using a special releasing tool or without substantial damage to the garment is extremely difficult. Further, as shown in FIG. 3, the tack head 22 is recessed in the transponder tag so that it is very difficult to pry off the head by inserting a pen knife, screw driver or the like under the head, or to clip the head off by means of hand cutters. To improve its resistance to being withdrawn from the fastener by pulling or twisting, the tack may be provided with a grooved shank.

It will be seen in FIG. 3 that the hooked ends 54 and 58 of the legs 52 and 56, respectively, are not in alignment with the end wall slots 40 so that they cannot be readily seen through the slots. More specifically, the transverse distance between the slots 40 is greater than that between the ends 54 and 58; in other words, the ends 54 and 58 lie between the slots 40 as viewed in FIG. 3. Even if the ends 54, 58 were discernible, the release of fastener 34 requires the simultaneous inward compression of the hooked ends 54 and 58 which is a difficult manipulation in the absence of the special releasing mechanism to be described.

The key 28 (FIG. 1) comprises a pair of parallel rods 80 counter-rotatable in unison and having tabs 82 secured to the ends thereof. The key is inserted in the slots 40 of either end wall 38 to the extent that the tabs 82 are positioned alongside the hooked ends 54 and 58. Inward rotation of the rods 80 in the directions shown by the arrows brings the tabs 82 into contact with the hooked ends of the fastener legs and presses them inwardly. The tack is then easily removed. Each tab 82 is sufficiently long to simultaneously engage both of the ends 54 of the legs 52.

Turning to FIGS. 4–6, there is shown a mechanism 90 for receiving the merchandise monitor 10 and releasing the attachment device 14 by actuating the key 28. Such mechanism would, of course, be in the custody of and operated by authorized sales personnel only.

The mechanism 90 includes an elongated base 92 supporting a block 94. The block 94 has a longitudinal guideway 96 for receiving the keeper 20. The guideway 96 extends along the block 94 from the outer end thereof and terminates at an abutment surface 98.

The rods 80 of the key 28 are carried by parallel spindles 100 journalled for rotation in an upright bearing plate 102 secured to the base 92. The block has a longitudinal slot 104 in communication with the guideway 96 to accommodate the spindles 100.

Identical pinions 106, attached to the inner ends of the spindles 100, are in mesh so that rotation of one spindle through a given angular displacement produces counterrotation of the other spindle through a like angular displacement. One of the pinions 106 is rotated by a drive gear 108 carried by the bearing plate 102. The gear 108 is in turn rotated by a drive shaft 110 supported by a pair of spaced-apart posts 112 carried by the base 92. An actuating handle 114 is secured to the portion of the drive shaft 110 between the posts 112 for rotating the shaft. The handle 114 is biased to an upper limit position against stops 116 by a spring 118 connecting a lever 120 forming an extension of the handle 114 and a lug 122 on the base 92. The relative positions of the various elements are such that in the upper limit position of the handle 114 the tabs 82 are upright.

In operation, the monitor 10 is moved along the guideway 96 until the keeper 20 engages the abutment surface 98. At this point, the key 28 has entered the end wall slots 40 and the tabs 82 are in releasing position alongside the hooked leg ends 54 and 58. Pressing the handle 114 downward (FIG. 6) causes inward rotation of the tabs 82 to cause the tabs to engage and compress the hooked ends 54, 58 to release the tack. The tack 18 may then be removed to free the garment simply by lifting the transponder tag 12.

Releasing the handle 114 allows the key 28 to return to the initial position by the action of the spring 118. The transponder tag, tack and keeper are then ready for reuse.

The portion of the releasing mechanism 90 including the drive elements may be housed within an enclosure 124.

FIGS. 7–10 show a merchandise monitor **10*a* for attachment to a garment 16*a* and having features in accordance with an alternative embodiment of the invention. Elements thereof having substantially similar counterparts in the first embodiment of FIGS. 1–3 bear the same reference numerals used in connection with the first embodiment with the addition of letter suffixes. The monitor 10*a* includes generally a transponder tag 12*a* and an attachment device 14*a*, the latter comprising a tack 18*a* and keeper 20*a*. The keeper 20*a* includes a housing 30*a*, a cover 32*a* and a one way releasable clip or fastener 34*a***.

Figure 9:
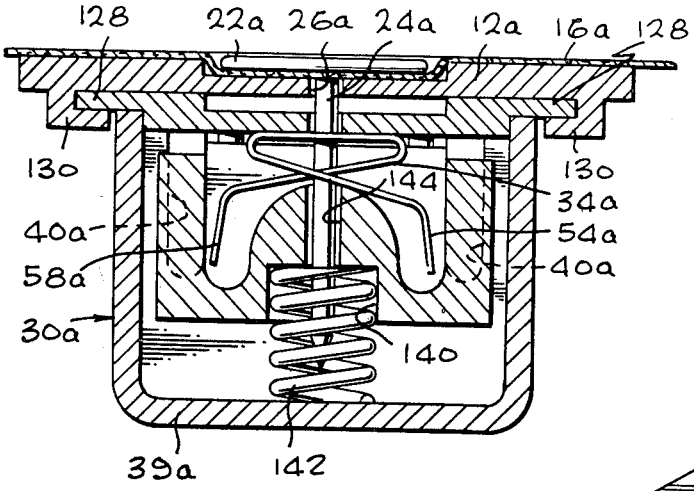
FIG. 9 is a front elevation view, in cross section, of the attachment device of FIGS. 7 and 8.

The cover plate **32*a* has outwardly extending flanges 128 received by longitudinally extending, L-shaped retainers 130 molded as an integral part of the transponder tag 12*a*. As best shown in FIG. 9, prior to insertion of the tack 18*a*, the keeper 20*a* is slid into place between the retainer 130 until the hole 26*a* in the transponder tag 12*a* lines up with the cover plate 70*a*. The tack is then passed through the garment 16*a*, through the transponder tag 12*a* and into the keeper 20*a*. It will be seen that the garment is directly under the tack head 22*a* which is therefore made substantially larger than that shown in the embodiment of FIGS. 1–3 so that the garment cannot be torn away from the attachment device without substantial damage to the garment. Further, the tack head 22*a* may be recessed in the tag as shown in FIG. 9** to discourage attempts to pry or cut off the head.

The embodiment of FIGS. 7–10 also includes inside the housing **30*a* a movable blocking gate 132 disposed under the fastener 34*a*. The gate 132 has a blocking position, as shown in FIG. 9, and a non-blocking position shown in FIG. 10. In the blocking position, the gate 132 improves the tamperproof nature of the device by at least partially covering and obstructing the end wall slots 40*a* and preventing the inward, tack-releasing movement of the hooked ends 54*a*, 58*a* of the fastener 34*a***, as will be described.

The gate 132 comprises a pair of upright walls 134 parallel with and adjacent the side walls 36a of the housing and spaced apart a distance that places them generally in alignment with the end wall slots 40a. The ends of each upright 134 include beveled cam surfaces 136. A generally semi-cylindrically shaped crown 138 projects upwardly between the uprights 134. A central bore 140 extends upwardly from the lower surface of the gate for receiving a compression spring 142 for biasing the gate upwardly toward the blocking position. A central hole 144 in the crown 138 communicates with the bore 140 to accommodate the tack shank 24a.

It will now be appreciated that in the blocking position of the gate 132, the crown 138, which is between the hooked ends 54a, 58a of the fastener 34a, prevents the hooked ends from being pressed together.

Release of the attachment device of FIGS. 7–10 requires that the gate 132 first be moved downwardly. This must be accomplished by applying equal, downward pressure simultaneously on both uprights 134 to moving both sides of the gate 132 down evenly. In the absence of such equal pressure on both sides simultaneously, the gate 132 will tilt to one side or the other and jam between the housing side walls 36a preventing further downward movement of the gate.

Figure 7:
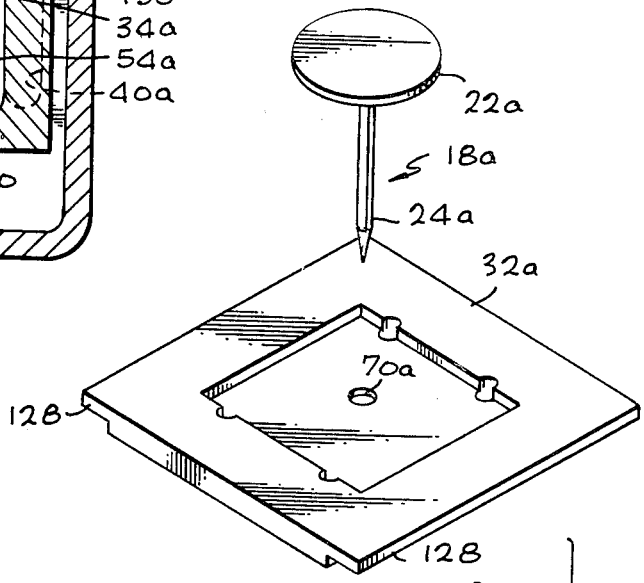
FIG. 7 is a perspective view of another merchandise monitoring apparatus secured to a garment, the apparatus including an attachment device according to a second embodiment of the invention, and showing a portion of an apparatus for releasing the attachment device.
Figure 8:
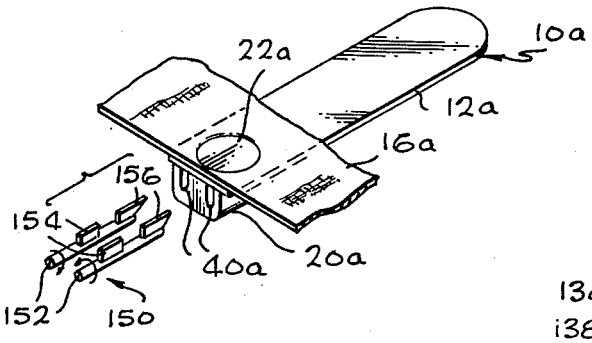
FIG. 8 is an exploded, perspective view of the attachment device of FIG. 7.
Figure 8:
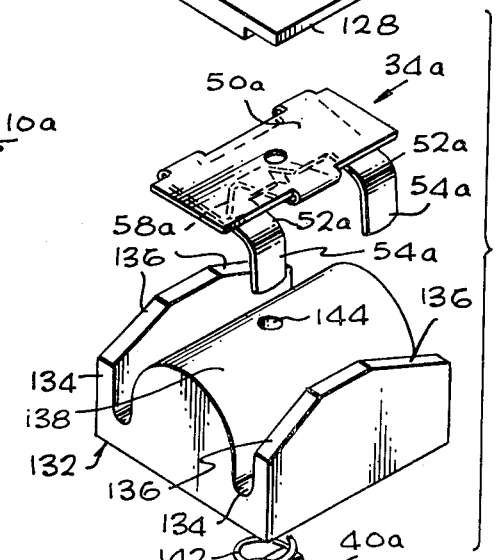
Figure 8:
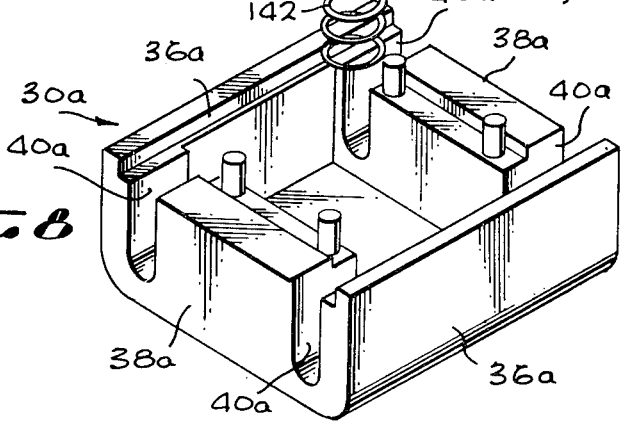

FIGS. 7 and 10 show means insertable into the slots 40a for releasing the attachment device 14a. Such releasing means comprises a key 150 including a pair of rods 152 carrying a first pair of tabs 154 of generally rectangular configuration and a second pair of tabs 156 positioned at the outer extremities of the rods and in alignment with the tabs 154. Each tab 156 includes a forward inclined or ramp edge 158. It will be seen that insertion of the key 150 into the slots 40a of one of the end walls 38a causes the inclined edges 158 to engage the cam surfaces 136a of the gate 132 and move the gate down against the action of the spring 142. The forward tabs 156 eventually emerge from the slots in the opposite end wall of the keeper at which point the rectangular tabs 154 are in position to release the fastener 34a. Rotation of the key 150 in the direction of the arrows shown in FIG. 7 will then cause the tabs 154 to press the hooked leg ends 54a, 58a inwardly to release the tack 18a. Upon completion of this operation the key is returned to its original position in which the tabs are in an upright position. Withdrawal of the key permits the spring 142 to urge the gate 132 back to its initial blocking position.

A releasing mechanism identical to that shown in FIGS. 4–6 may be used to release the attachment device 14a of FIGS. 7–10, the only difference being that the dual tab key 150 would be substituted for the single tab key 28 shown in FIGS. 4–6.

FIGS. 11 and 12 show a third embodiment of the attachment device of the invention which is adapted to be released pneumatically. The attachment device of this embodiment, designated by the reference numeral 14b, includes a tack 18b adapted to be received by a keeper 20b comprising generally a housing 30b, a cover 32b and a one-way fastener 34b of the kind already described.

Disposed inside the housing 30b is a pair of parallel, longitudinally oriented, spaced-apart diaphragms 162 each of which is firmly held in place by slots 164 and 166 formed, respectively, in the end walls 38b and bottom wall 39b of the housing 30b. The diaphragms 162 have inwardly-projecting, longitudinal ridges 163 disposed immediately adjacent the hooked ends 54b, 58b of the fastener 34b and are held along their top margins by longitudinal abutments 168 depending from the cover 32b. The diaphragms 162 thereby define within the housing 30b a pair of side chambers 170 separated by a larger, central chamber 172 enclosing the fastener 34b.

The fastener 34b is supported by steps 174 in the end walls of the housing 30b which receive the lateral base extensions 66b and is restrained from above by the cover 32b. The fastener is thereby maintained in a generally central position to provide approximate, tack-receiving alignment between the hole 60b in the base of the fastener and the hole 70b in the cover 32b.

The housing 30b also has means for connecting an external pressure source to the side chambers 170. For example, one of the end walls 38b may have a pair of small openings 178 each of which communicates with one of the side chambers 170 for admitting air under pressure into the side chambers. Such pressurization of the side chambers causes the diaphragms to bulge or deflect inwardly, the ridges 163 thereby making contact with and displacing the hooked leg ends 54b, 58b sufficiently to release the tack in the manner already described. To prevent substantial leakage around the diaphragms, they may be sealed around their peripheries with an appropriate compound.

In order to effect release of the tack, substantially equal pressures of sufficient magnitude, for example, 100 psi, are applied simultaneously to the side chambers 170. Such pressures can readily be applied through exceedingly small openings 178 which may have diameters of the order of 0.050 inch, by way of example. It will thus be appreciated that this embodiment of the invention is highly tamperproof and will defeat virtually any unauthorized attempt to remove the monitor short of substantially damaging the goods to which the monitor is attached.

To prevent excessive deflection of the diaphragms 162, stops 180 projecting upwardly from the bottom wall 38b may be provided.

FIG. 13 shows in somewhat schematic form an apparatus for releasing the attachment device 14b of FIGS. 11 and 12. The apparatus includes a small cylinder 182 enclosing a piston 184 adapted to be driven by an appropriate mechanism (not shown) through a connecting rod 186. Leading from the top of the cylinder 182 is a generally Y-shaped tube assembly 188 having a pair of ends 190 positioned to be received by the pair of openings 178 in the housing end wall 38b.

In using the apparatus of FIG. 13, the monitor is pushed against a stop 192 to cause entry of the tube ends into the openings 178. Advancement of the pistons 184 then causes air under pressure to enter the side chambers 170 to cause release of the tack 18b as already described. Only about one-half cubic inch piston displacement is required, in accordance with one example of this feature of the invention to produce the required pressurization of the side chambers 170.

FIG. 14 shows a variation of the attachment device of FIGS. 11 and 12 tending to add to its tamper resistance. The end wall 38b, opposite the end wall 38b having the openings 178, has formed therein a passage 196 connecting the side chambers 170. This makes it necessary to supply air to both chambers simultaneously, since air supplied through only one of the openings 178 would be expelled from the other opening 178.

What is claimed is:

1. A mechanism for releasing a device for attaching a monitor to an article of merchandise, the attaching device including a tack having a shank and a keeper for receiving the shank, the keeper enclosing a fastener having opposed elements for gripping the shank, displacement of the opposed gripping elements toward releasing positions permitting withdrawal of the shank from the keeper, the keeper further having a pair of openings for receiving key means adapted to engage and displace the fastener gripping elements to the shank-releasing position, the releasing mechanism comprising:

base means;

a pair of horizontal, parallel spindles journalled for rotation in the base means, the spindles being coupled for counter-rotation and spaced apart a distance equal to the distance between the pair of openings in the keeper, the spindles further having outer end portions comprising key means including tabs adapted to engage the fastener gripping elements and displace the gripping elements to the shank-releasing position upon rotation of the spindles;

an actuator supported by the base means and coupled to rotate the spindles, the actuator being pivotally mounted on the base means for movement between a first position in which the tabs are oriented in a non-engaging position relative to the fastener and second position in which the tabs are oriented in a fastener-engaging position, the base means further including a stop for engagement by the actuator in the first position thereof;

means for biasing the actuator against the stop; and means for supporting the monitor in operative relationship to the key means.

* * * * *